US008978635B2

(12) United States Patent
Monks et al.

(10) Patent No.: US 8,978,635 B2
(45) Date of Patent: Mar. 17, 2015

(54) METHOD OF TRANSFERRING DATA IN A PROJECTILE LAUNCHING DEVICE

(75) Inventors: Steven John Monks, Manchester (GB); Matthew Paul Stockdale, Manchester (GB)

(73) Assignee: Planet Eclipse Limited, Trafford Park, Manchester (GB)

( * ) Notice: Subject to any disclaimer, the term of this patent is extended or adjusted under 35 U.S.C. 154(b) by 150 days.

(21) Appl. No.: 13/567,847

(22) Filed: Aug. 6, 2012

(65) Prior Publication Data

US 2013/0039655 A1 Feb. 14, 2013

Related U.S. Application Data

(60) Provisional application No. 61/521,123, filed on Aug. 8, 2011.

(51) Int. Cl.

| | |
|---|---|
| ***F41B 11/57*** | (2013.01) |
| ***F41B 11/71*** | (2013.01) |
| ***F41A 9/53*** | (2006.01) |
| ***F41A 17/06*** | (2006.01) |

(52) U.S. Cl.

CPC . *F41B 11/71* (2013.01); *F41A 9/53* (2013.01); *F41A 17/06* (2013.01); *F41B 11/57* (2013.01)

USPC ..... 124/32

(58) Field of Classification Search

CPC ..... F41B 11/57

USPC ..... 124/32; 89/6.5

See application file for complete search history.

(56) References Cited

U.S. PATENT DOCUMENTS

| | | | | |
|---|---|---|---|---|
| 5,816,232 | A | 10/1998 | Bell | |
| 6,412,207 | B1 * | 7/2002 | Crye et al. | 42/70.06 |
| 6,941,693 | B2 | 9/2005 | Rice et al. | |
| 6,966,313 | B1 * | 11/2005 | Yokota et al. | 124/32 |
| 7,673,627 | B2 * | 3/2010 | Higgins et al. | 124/51.1 |
| 8,312,870 | B2 * | 11/2012 | Higgins et al. | 124/51.1 |
| 2006/0042616 | A1 * | 3/2006 | Orr | 124/73 |
| 2007/0175463 | A1 | 8/2007 | Higgins et al. | |
| 2008/0105243 | A1 | 5/2008 | Monks | |
| 2009/0253103 | A1 | 10/2009 | Hogan, Jr. | |
| 2010/0154766 | A1 | 6/2010 | Skilling | |
| 2011/0061638 | A1 | 3/2011 | Kim | |
| 2012/0002976 | A1 * | 1/2012 | Gerber et al. | 398/140 |
| 2012/0227723 | A1 * | 9/2012 | Higgins et al. | 124/51.1 |

FOREIGN PATENT DOCUMENTS

| | | |
|---|---|---|
| GB | 2352022 A | 1/2001 |

* cited by examiner

*Primary Examiner* — Reginald Tillman, Jr.

(74) *Attorney, Agent, or Firm* — Barlow, Josephs & Holmes, Ltd.

(57) ABSTRACT

A method of transferring data in a projectile launching device includes providing a projectile launching device that has a transmitter and a receiver. An external device also includes its own transmitter and receiver. The receivers are in range with the transmitters. Data is sent from the transmitter on the projectile launching device to the either or both the receiver on the projectile launching device and the receiver on the external device. Data is sent from the transmitter on the projectile launching device to either or both the receiver on the projectile launching device and the receiver on the external device. As a result, the projectile launching device communicates with the external device.

9 Claims, 14 Drawing Sheets

METHOD OF TRANSFERRING DATA IN A PROJECTILE LAUNCHING DEVICE

CROSS REFERENCE TO RELATED APPLICATION

This application is related to and claims priority from earlier filed provisional patent application Ser. No. 61/521,123, filed Aug. 8, 2011, the entire contents thereof is incorporated herein by reference.

BACKGROUND OF THE INVENTION

The invention relates generally to projectile launching devices, such as paintball markers, and methods and systems for transferring information between such projectile launching devices and other devices, such as barrels, loading systems or hoppers, pressure regulators and compressed air bottles (gas tanks). While the present invention is discussed in detail here in connection with paintball markers, the present invention relates to any type of projectile launching device.

More specifically, the present invention relates to communication of a paintball marker with an external device to enable data transfer therebetween for operational and configuration purposes.

In the paintball manufacturing industry there are a number of standards that govern how different pieces of equipment, often manufactured by different manufacturers will interface together. Examples of this equipment are paintball markers; barrels; paintball loading systems; pressure regulators; and compressed air bottles. Typically these standards specify thread sizes, bore sizes, hole centers or pressure ranges. Most notably, there are no standards that specify how electronic circuits can interface together between projectile launching devices and external devices. In the prior art, there are many reasons for lack of such as standard. This is most likely because of the physical size constraints with projectile launching devices and related external components as it is not always practical to mount an electrical connector in a convenient location on a product, nor is possible to create space inside one product for the addition of another product and in many products the addition of a wireless communication system is cost prohibitive.

Also, in the paintball equipment manufacturing industry paintball markers are seldom manufactured to order and will often be stored prior to distribution. Once an order for paintball markers is received it is often necessary to reconfigure the paintball markers to comply with the regulations that apply to the region or country to which the paintball markers are to be sent. In the case of an electronic control system for a paintball marker, existing manufacturing practices require that the electronics either be modified, replaced or that the marker be connected to a computer in order that the operation of the electronics be modified. This can be a time consuming, and therefore costly operation. As above, there is difficulty providing an interface by which to configure a paintball marker. There are no known solutions to address this problem.

Therefore, there is a need to provide an data communication interface to a projectile launching device.

There is a need to provide a data communication interface to a an external device that interoperates with a projectile launching device.

There is a further demand for a data communication interface in a projectile launching device that uses existing hardware in the projectile launching device.

There is a further need for a data communication interface to enable a projectile launching device to communicate with an external device for transfer of data concerning configuration, operational information, and the like.

SUMMARY OF THE INVENTION

The present invention preserves the advantages of prior art systems and methods, systems and devices that are used to provide data communication interfaces in a projectile launching device. In addition, it provides new advantages not found in currently available methods, systems, and devices and overcomes many disadvantages of such currently available methods and systems.

By way of background, it is well known in the art that many paintball markers make use of a paintball sensing system that only allows the paintball marker to fire once a paintball is in a position to be fired. In most of these markers the sensing system is based upon opto-electronics whereby a transmitter is mounted on one side of the breech of the marker and a receiver is mounted on the opposite side of the breech so that any object coming between the transmitter and receiver can be detected. This is known as a photo-interrupter and is well known to those skilled in the art. In typical use, when something is detected between the transmitter and receiver, the electronic control system assumes that it is a paintball that is being detected and allows the marker to be fired.

In accordance with the present invention, the present invention makes use of this existing photo-interrupter to transfer information between the electronic control system of the paintball marker and the electronic control system of another, external device. That information may be in the form of a simple "go/stop" signal or it may be more complex in the form of a stream of pulses; in the form of a frequency modulated signal; or in some other form. All of these forms of information transfer will be understood by those skilled in the art and are considered within the scope of the present invention.

To carry out the present invention, data is transferred in a projectile launching device wherein the projectile launching device includes a transmitter and a receiver in the breech. An external device also includes its own transmitter and receiver. The receivers are in range with the transmitters. Data is sent from the transmitter on the projectile launching device to the either or both the receiver on the projectile launching device and the receiver on the external device. Data is sent from the transmitter on the projectile launching device to either or both the receiver on the projectile launching device and the receiver on the external device. As a result, the projectile launching device communicates with the external device.

The projectile launching device can communication with a wide array of different types of external devices, such as barrels, loaders/hoppers, pressure regulators, compress gas tanks and configuration devices.

Therefore, it is an object of the present invention to provide a data communication interface to a projectile launching device.

A further objection of the present invention is to provide a data communication interface to a an external device that interoperates with a projectile launching device.

Another object of the present invention is to provide a data communication interface in a projectile launching device that uses existing hardware in the projectile launching device.

Another object of the invention is to make use of existing standards for the location of the photo-interrupter.

Yet another object of the present invention is to provide a data communication interface to enable a projectile launching device to communicate with an external device for transfer of data concerning configuration, operational information, and the like.

It is a further object of the present invention to provide a system, method and device that can easily and quickly send data between a projectile launching device and external device or configure or re-configure a projectile launching device.

Another object of the present invention is to provide a system, method and device that are much simpler to execute than prior art methods and systems.

Yet another object of the present invention is to provide a data communication devices, methods, and systems that are less expensive that prior art devices, methods and systems.

Another object of the invention is to provide a less expensive means of interfacing between electronic products than prior art devices and systems.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
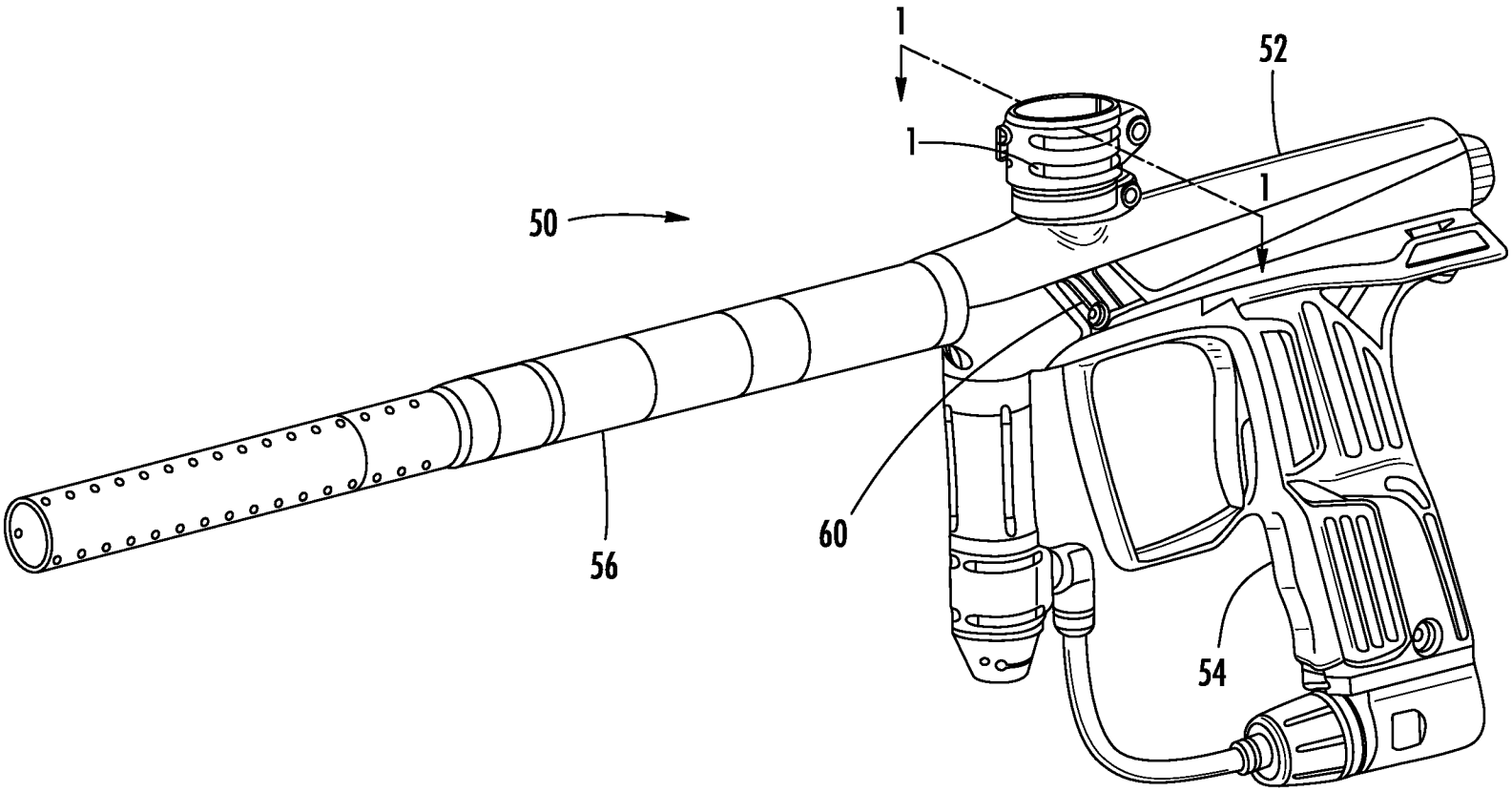
FIG. 1 (PRIOR ART)
FIG. 1 is a typical prior art paintball marker.

Referring first to FIG. 1, a typical projectile launching device 50 is shown. In this example, a paintball marker 50 is shown but other devices, such as airsoft guns, may employ the method and device of the present invention. For ease of illustration and discussion, a paintball marker 50 and its use of the method and device of the present invention is discussion herein.

Figure 8:
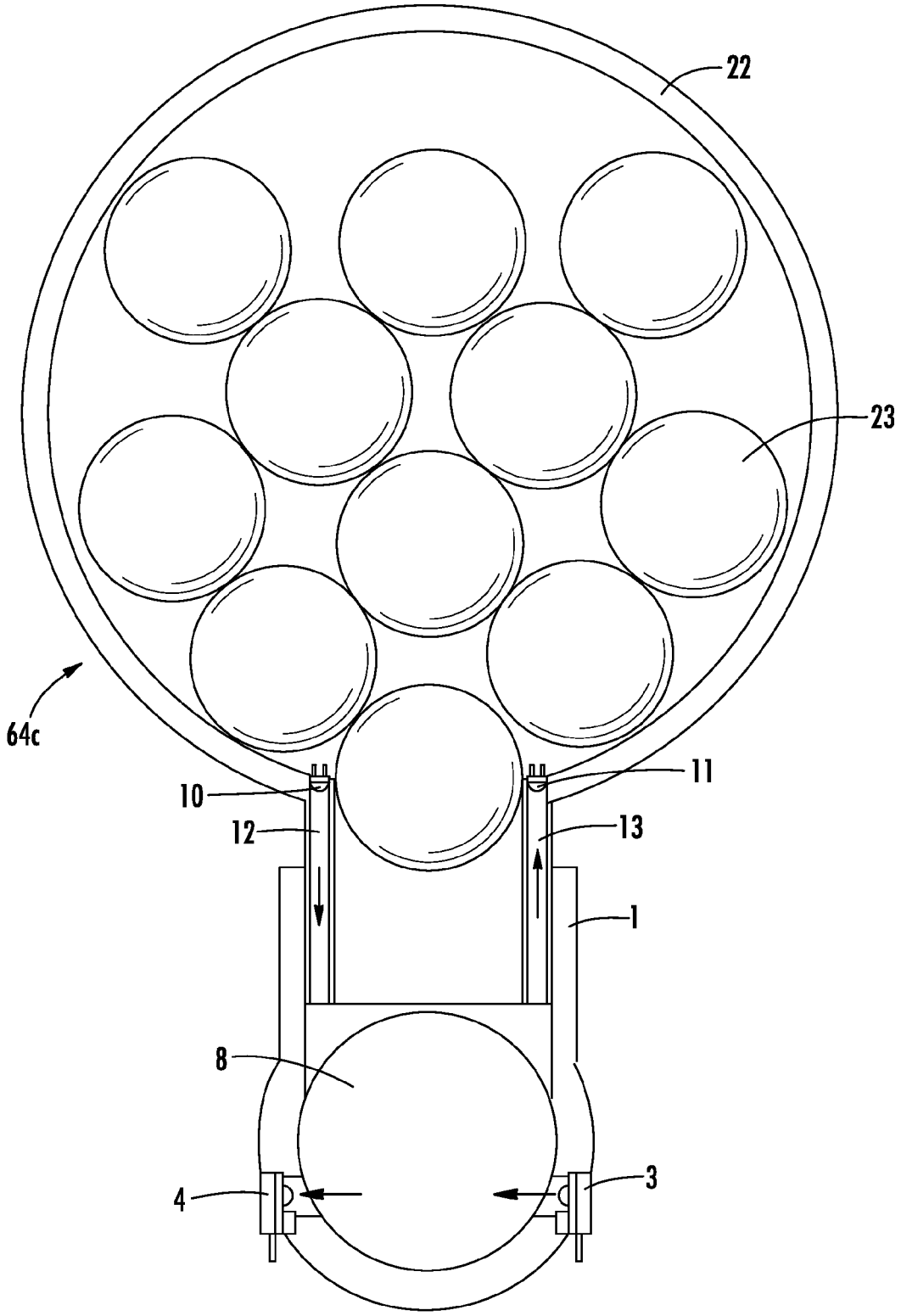
FIG. 8 is a front view of the empty breech and feed-neck of a typical marker, sectioned along the center of the feed-neck and showing a second embodiment of an external device in an interfacing position.

In FIG. 1, a paintball marker 50 is shown to include the usual main body 52, grip frame assembly 54 and barrel 56. FIG. 1 also illustrates the location of the standard feed-neck (or feed port) 1, which provides an entry point for paintballs (not shown in FIG. 1) into the paintball marker 50, and the location of one side of the paintball sensing system 60 with the main body 52 of the paintball marker 50. A hopper or loading system 62 is attached to the feed-neck 1 (as seen in FIG. 8), to supply paintballs into a breech of the paintball marker 50 for launching thereof. During the normal operation of the paintball marker 50, the paintball marker 50 is not allowed to fire when there is no paintball loaded into the paintball marker 50 and is allowed to fire when a paintball is loaded into the paintball marker 50. This paintball detection system 60 is used to detect the presence, and absence, of a paintball and works as follows, as shown in FIGS. 2 and 3.

Figure 2:
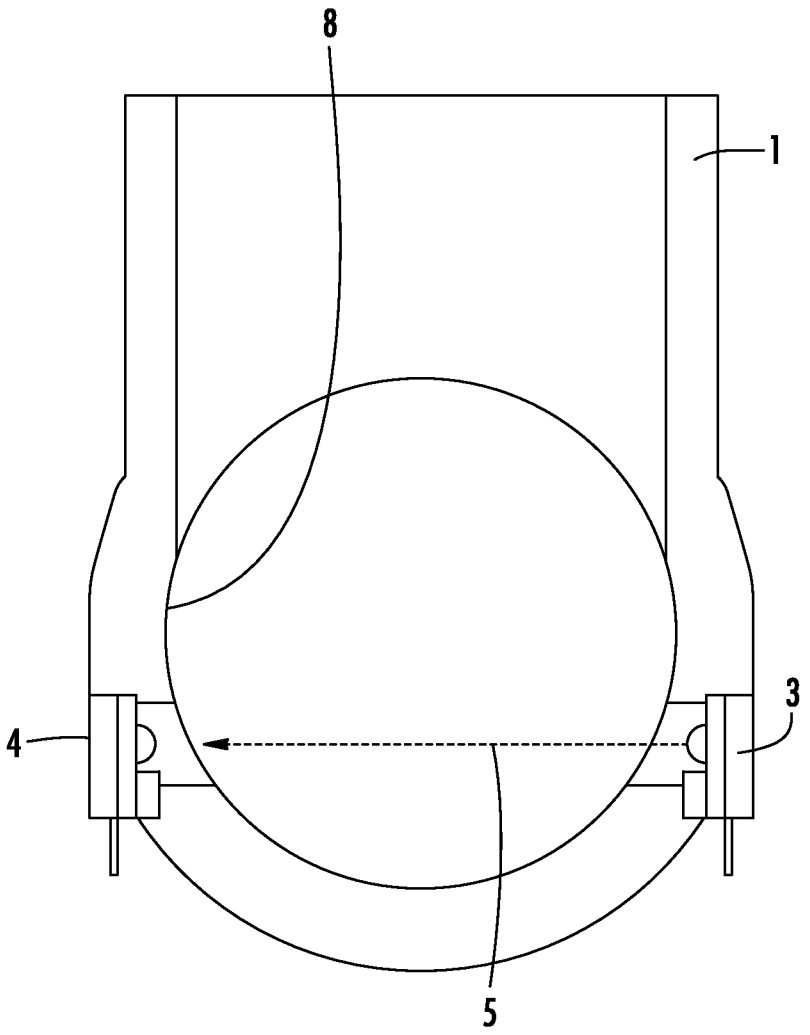
FIG. 2 (PRIOR ART)
FIG. 2 is a front view of the empty breech and feed-neck of a typical marker through the line 1-1 of FIG. 1 along the center of the feed-neck.

Turning now to FIG. 2, a cross-sectional view through the line 1-1 of FIG. 1 shows the feed-neck 1 and empty breech 8. Information (data) is electronically sent from the electronic control system of the paintball marker to a transmitter 3 mounted on one side of the breech 8. The transmitter 3 converts the electrical information to an optical signal and transfers the information (data) opto-electronically as 5 across the breech 8 to a receiver 4 on the opposite side of the breech. The receiver 4 collects the information (data) 5 and returns it to the electronic control system of the paintball marker. The presence of the received information (data) 5 indicates the absence of a paintball. Such a system is preferably opto-electrical but other types of non-contact systems may be used.

Figure 3:
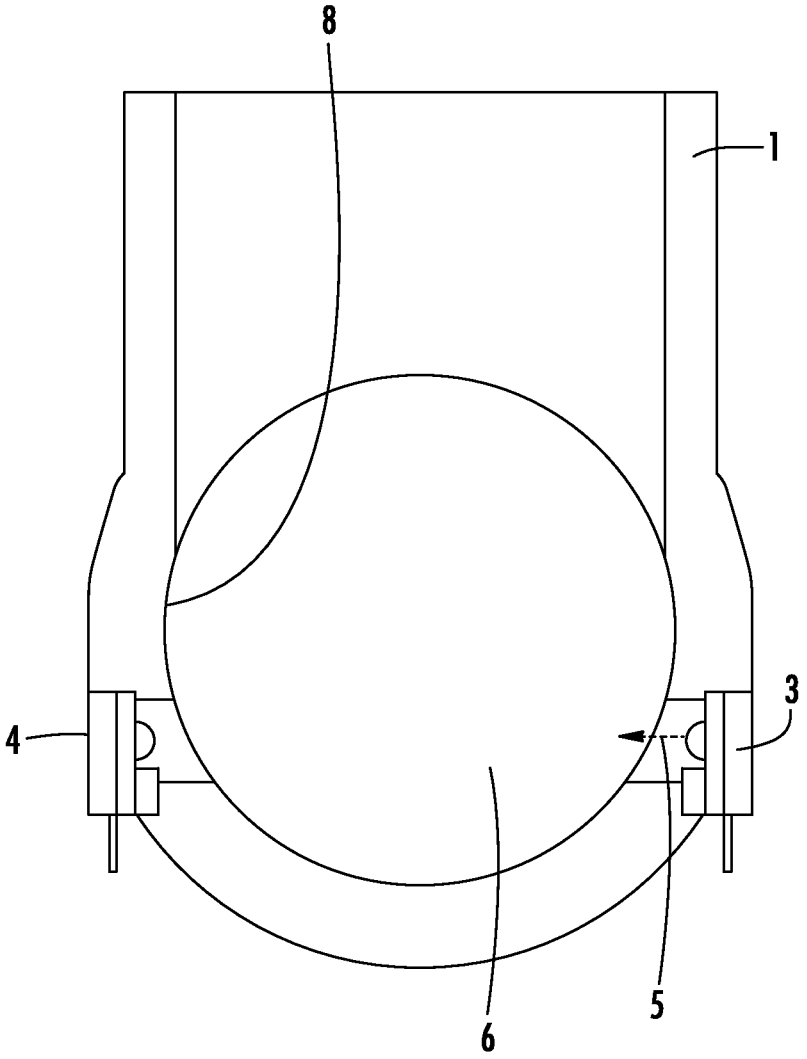
FIG. 3 (PRIOR ART)
FIG. 3 is a front view of the breech and feed-neck of a typical marker through the line 1-1 of FIG. 1 along the center of the feed-neck and showing a paintball loaded into the breech.

In FIG. 3, a paintball 6 has entered the breech 8 through the feed-neck 1 and is stopping the information 5 emitted from the transmitter 3 from reaching the receiver 4 and so no information is returned to the control system of the paintball marker and this absence of information indicates the presence of a paintball 6 in the breech 8. As a result, the paintball marker 50 can then initiate the paintball launching process.

The present invention uses the above known and existing opto-electrical system as it is intended and can simultaneously, or in alternating multiplexed fashion, repurpose such a system for other purposes, namely for communication of the paintball marker 50 to other components of the marker, such as external devices, including loading systems, barrels, pressure regulators and compressed air tanks. Such communication between the marker 50 and the other devices connected thereto permits better interoperation of the marker 50 as a whole. The method and system of the present invention permits such communication in a more efficient and cost effective way compared to prior art methods and systems.

Figure 4:
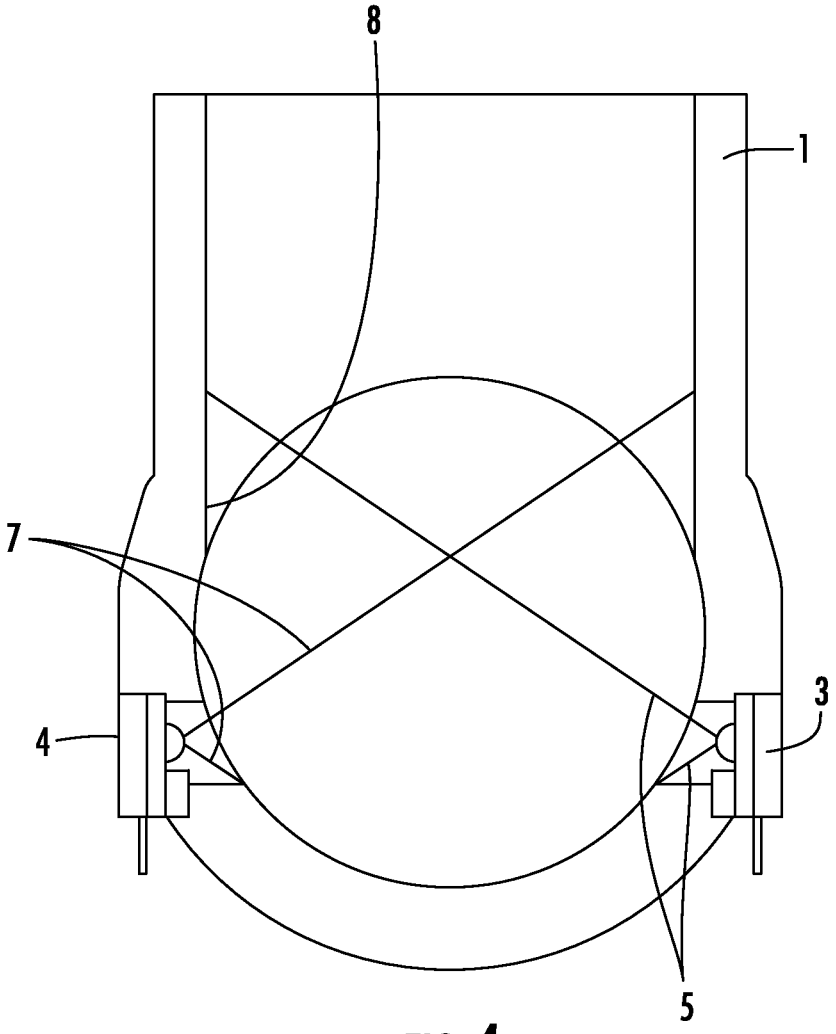
FIG. 4 is a front view of the empty breech and feed-neck of a typical marker through the line 1-1 of FIG. 1 along the center of the feed-neck and showing the ranges of the transmitter and detector.

The structure and configuration of an existing opto-electrical system in a paintball marker 50 is employed by the method and device of the present invention. More specifically, FIG. 4 shows the information 5 being radiated conically outwards, as bounded by lines 5 in FIG. 4, from the transmitter into a conical detection range area bounded by lines 7 of the receiver 4. As will be shown below in connection with FIGS. 5A-C and 6A-6B, these transmission and detection areas provide a range to allow a second receiver and a second transmitter to interface with the transmitter 3 and receiver 4 of the paintball detection system to carry out the method of the present invention.

Figure 5A:
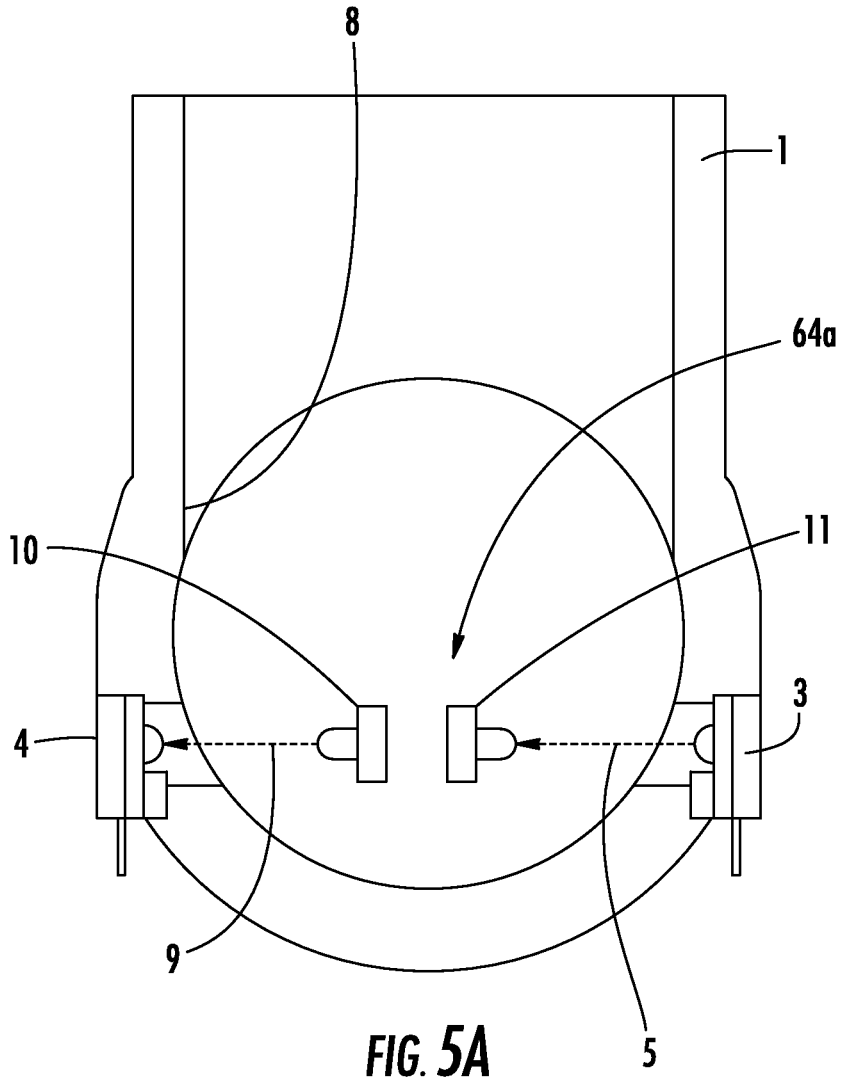
FIG. 5A is a front view of the empty breech and feed-neck of a typical marker, sectioned along the center of the feed-neck and showing one possible location for an interface to an external device.
Figure 5B:
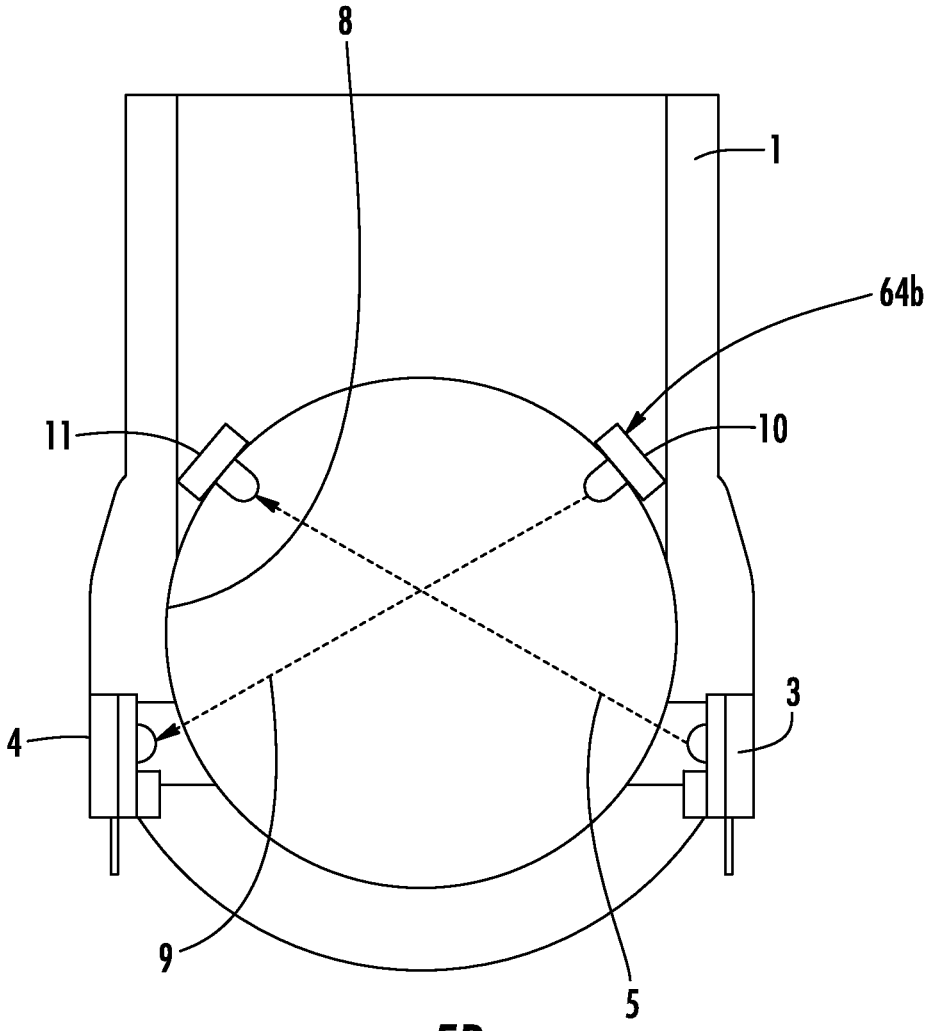
FIG. 5B is a front view of the empty breech and feed-neck of a typical marker, sectioned along the center of the feed-neck and showing a second possible location for an interface to an external device.
Figure 5C:
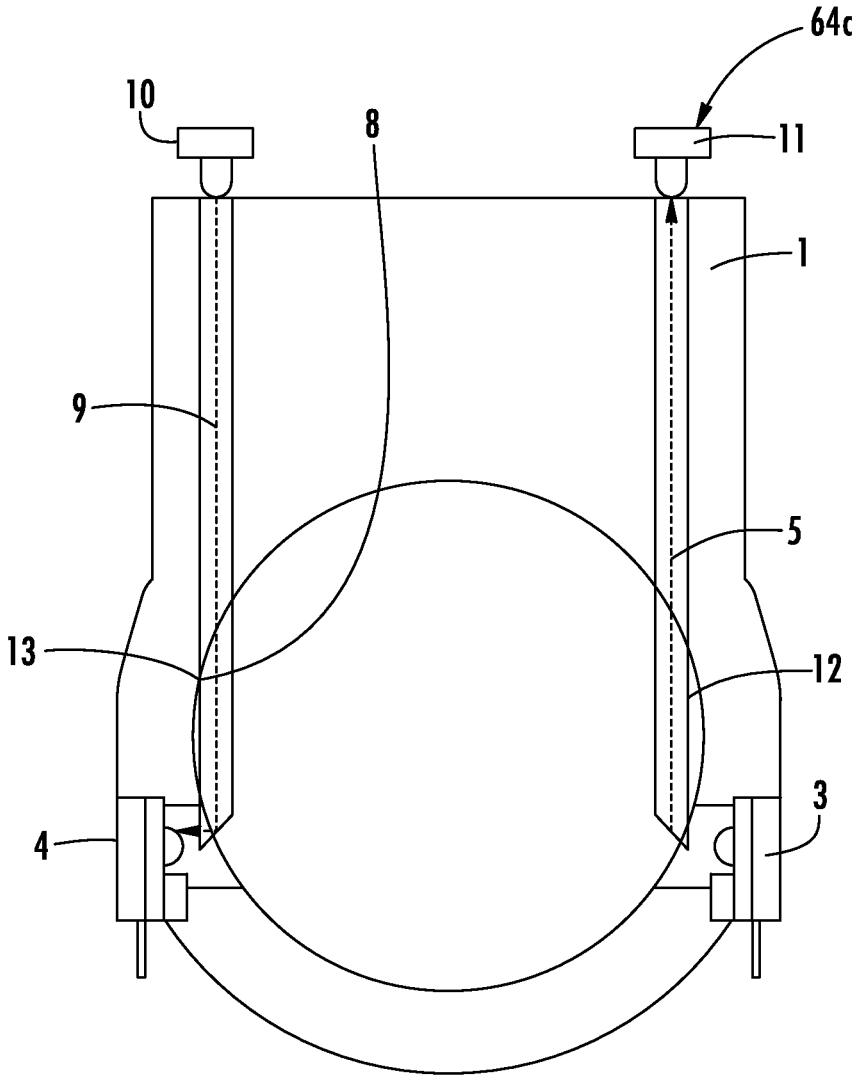
FIG. 5C is a front view of the empty breech and feed-neck of a typical marker, sectioned along the center of the feed-neck and showing a third possible location for an interface to an external device.
Figure 7A:
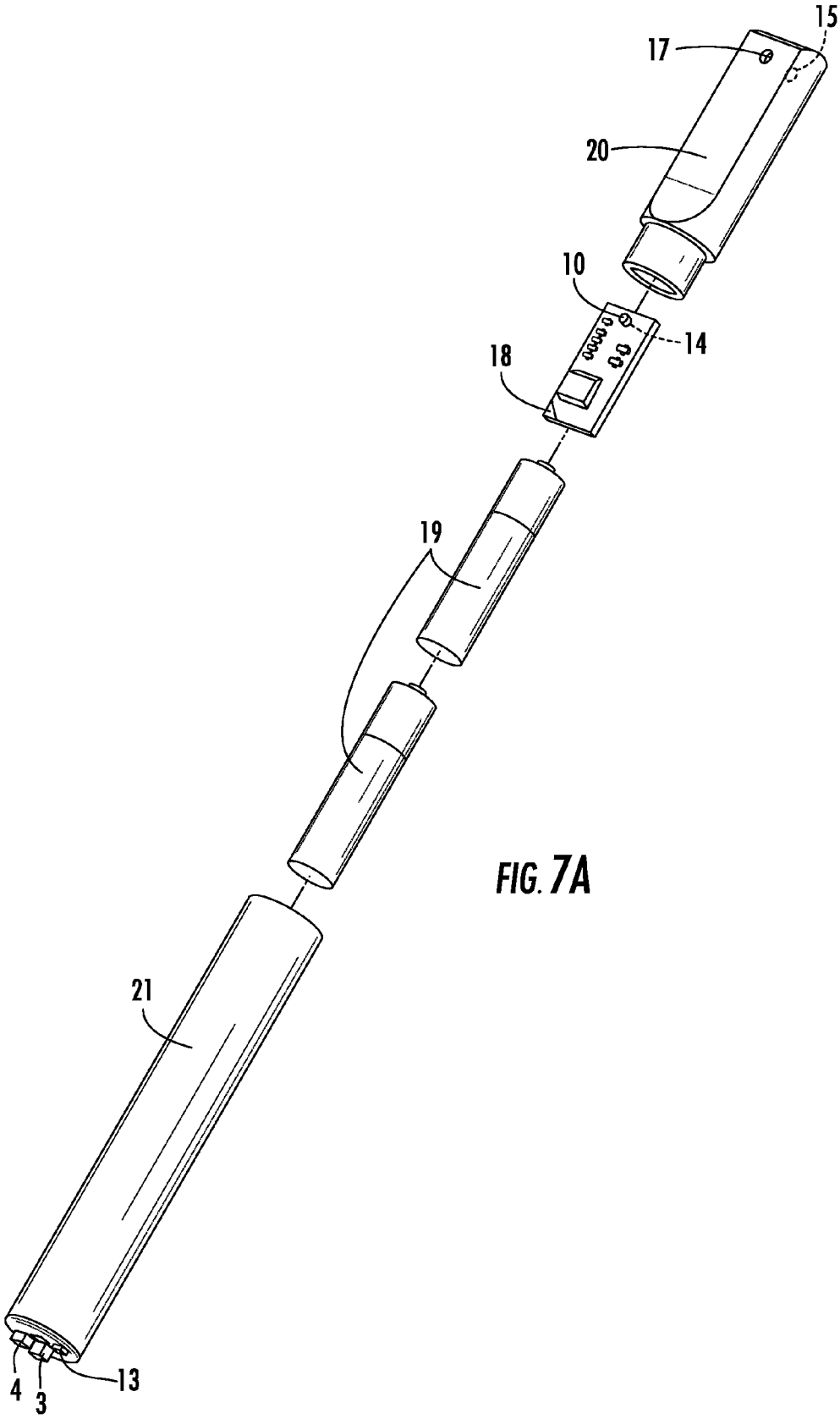
FIG. 7*a* is an exploded view of a first embodiment of an external device in the form of a configuration device.
Figure 7B:
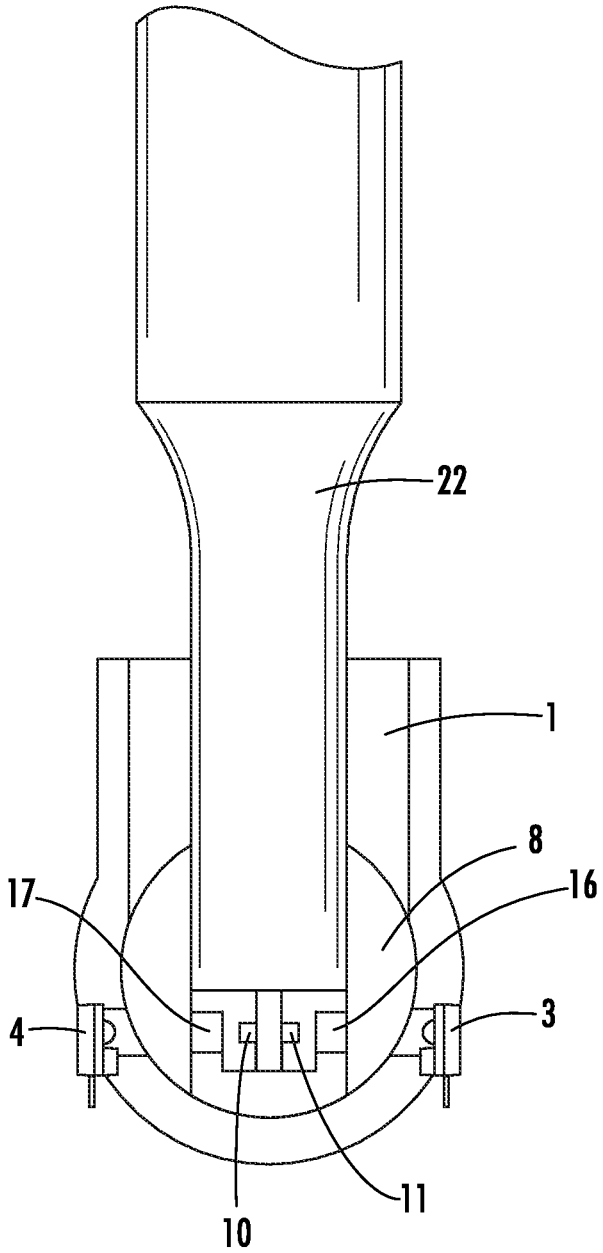
FIG. 7*b* is a front view of the breech and feed-neck of a typical marker, sectioned along the center of the feed-neck and showing the first embodiment in an interfacing position.
Figure 7C:
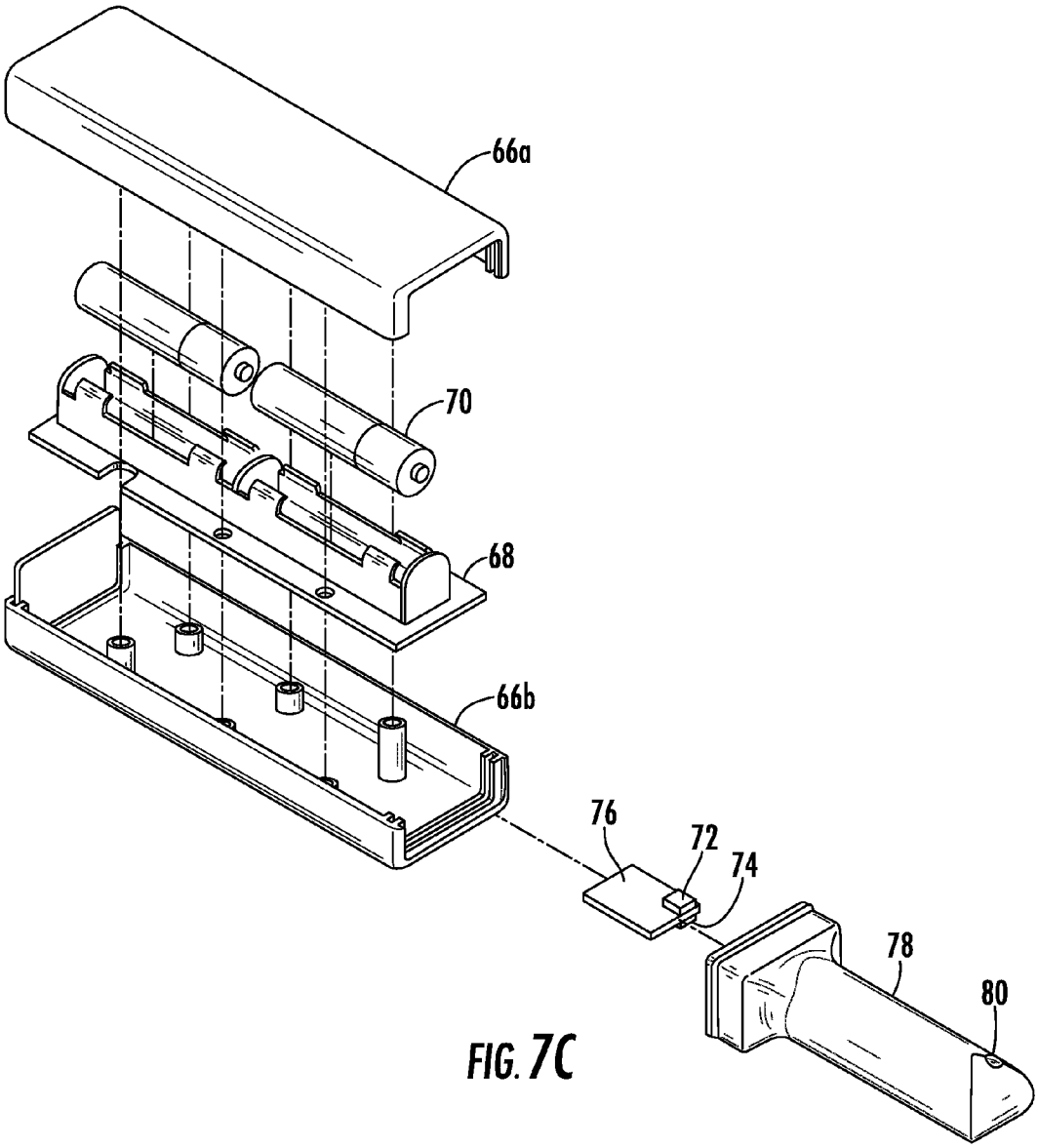
FIG. 7*c* is an exploded view of a rectangular configuration of the device of the present invention.

FIGS. 5A-C show a number of different embodiments where the opto-electrical system of the paintball marker can communicate with an external device 64 that is connected to or proximal to the paintball marker 50. In FIG. 5A, a first example of how an external device 64*a* can opto-electrically communicate with the opto-electrical system of the paintball marker. In this example, a configuration device could be the external device 64*a* that is located in the breech 8 of the paintball marker 50 to transmit configuration data to the marker 50. Further details of this configuration external device 64*a* is shown in FIGS. 7A-C. Referring back to FIG. 5A, receiver 11 and transmitter 10 of an external device 64*a* such that the external device 64*a* can interface with the paintball marker 50. Information 5 is transferred from the transmitter 3 of the paintball marker to the receiver 11 of the external device 64*a* and information 9 is transferred from the transmitter 10 of the external device 64*a* to the receiver 4 of the paintball marker 50. Thus, the receiver 4 of the paintball marker 50 can be re-purposed to receive configuration data from the external device in FIG. 5A in addition to simply being used to detect the presence or lack of presence of an optical transmission signal for paintball presence purposes. FIGS. 7A-C and the description related thereto provide additional details regarding the operation thereof.

Turning now to FIG. 5B, another embodiment of the present invention is shown where a different possible location of the receiver 11 and transmitter 10 of an external device 64*b* is provided such that the external device 64*b* can interface with the paintball marker 50. In this case, the transmitter 10 and receiver 11 of external device 64*b* are located transversely across the receiver 4 and transmitter 3 of the paintball marker, respectively.

Yet another embodiment of the present invention is shown in FIG. 5C where the external device 64*c* is located more remotely from the breech 8 of the paintball marker 50. This is another possible location of the receiver 11 and transmitter 10 of an external device 64*c* such that the external device can interface with the paintball marker 50. In this embodiment, the information 5 is diverted by a light-pipe 12 to the receiver 11 of the external device 64*c* and information 9 is diverted by a second light pipe 13 to the receiver 4 of the paintball marker 50. For example, the embodiment of FIG. 5C has particular application and use when the external device 64*c* is a hopper or loading system that is attached to the feed-neck or feed port 1 of the paintball marker 50.

Figure 6A:
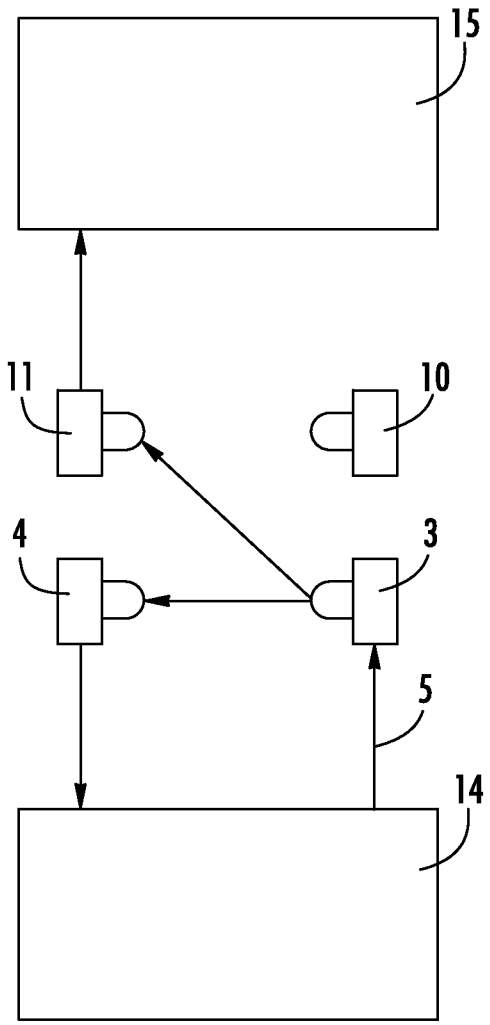
FIG. 6A is a block diagram showing the flow of information between the paintball marker and an external device.
Figure 6B:
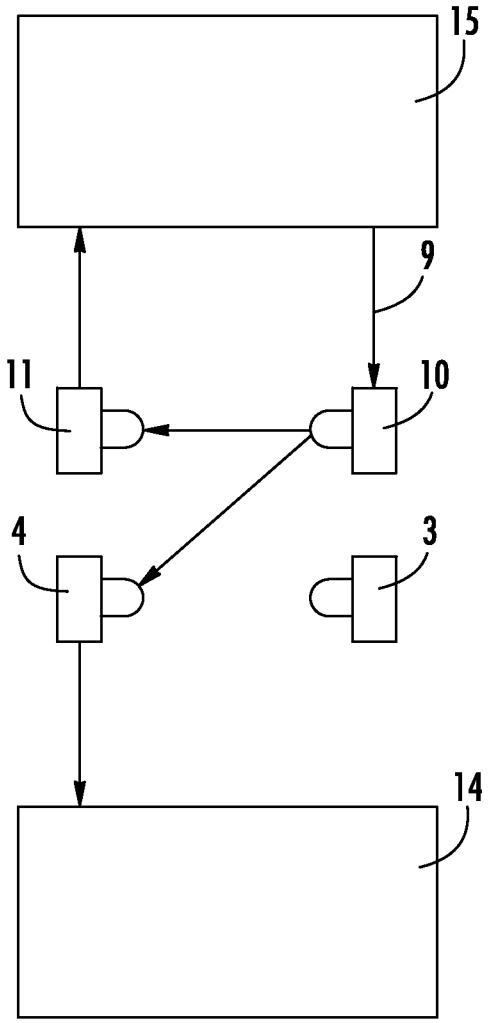
FIG. 6B is a block diagram showing the flow of information between an external device and the paintball marker.

FIGS. 6A and 6B conceptually illustrate the flow of data within a paintball marker 50 that employs the method and system of the present invention. Referring to FIG. 6A, during normal operation, the electronic control system 14 of the paintball marker sends information 5 to the transmitter 3 of the paintball detection system. Such information 5 is translated from electrical data to an optical signal. That information 5 is typically, but not limited to, a single pulse. The information 5 is transferred opto-electronically to the receiver 4 of the paintball detection system which passes the information to the electronic control system 14 of the paintball marker 50 and from this information 5 the electronic control system 14 determines whether a paintball 6 is present. The process of such detection is described in detail above.

However, uniquely and in accordance with the present invention, the information 5 that is optically transmitted by transmitter 3 is simultaneously received by the receiver 11 of an external device in proximity with the conical range of transmission of the transmitter 3. Receiver 11 receives the information from transmitter 3 and converts it to electrical data and passes it to the electronic control system 15 of that external device, which takes this information 5 as a signal that there is a window of time to send information to the paintball marker 50.

Referring to FIG. 6B, the electronic control system 15 of the external device 64*a*, 64*b* or 64*c* (generally referred to as 64) sends information 9 to the transmitter 10 of the external device 64. That information 9 is typically, but not limited to, a series of pulses representing complex information. The information 9 is transferred, via transmitter 10, to the receiver 4 of the paintball detection system 60 of the paintball marker 50 which passes the information 9 to the electronic control system 14 of the paintball marker 50. The information 9 may be simultaneously received by the receiver 11 of the external device 64 but is typically ignored. Essentially, FIG. 6B illustrates how the external device 64 can send information to the paintball marker 50 to, in combination with FIG. 6A, provide bi-directional communication between the paintball marker 50 and an external device 64.

Referring back to FIG. 6A, the electronic control system 14 of the paintball marker sends information 5 to the transmitter 3 of the paintball detection system. That information 5 is typically, but not limited to, a series of pulses representing complex information. The information 5 is transferred opto-electronically to the receiver 11 of the external device which passes the information 5 to the electronic control system 15 of the external device 64. This cycle is then repeated.

There many permutations of the above as to whether the communication between the paintball marker 50 and the external device 64 is bi-directional or uni-directional from the paintball marker to the external device 64 or vice versa. For example, it may be the case that the external device only needs to receive information from the paintball marker 50 in which case information will only flow from the paintball marker 50 to the external device 64 as shown in FIG. 6A. It may also be the case that external device 64 only needs to send information to the paintball marker 50 in which case information will only flow from the external device 64 to the paintball marker 50 as shown in FIG. 6B. It may also be that the flow of information between the paintball marker 50 and the external device 64 occurs at infrequent intervals.

Figure 7D:
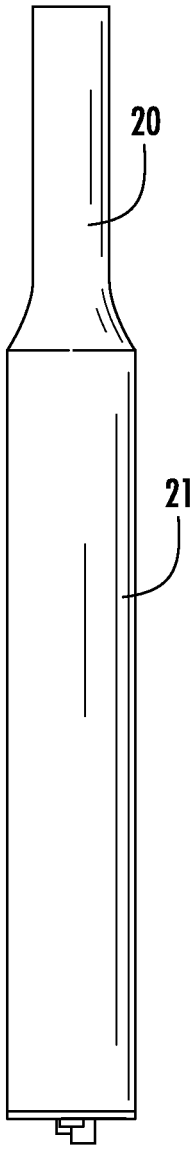
FIG. 7*d* is a side elevational view of the device of FIG. 7*a*.

FIGS. 7A-D provide further details as to the external device 64, namely device 64*a*, discussed above in connection with FIG. 5A. In this embodiment of the present invention, a configuration device, as an example, is used as the external device 64*a* that communicates with the projectile launching device 50. FIG. 7A shows an exploded view of a this embodiment of an external device 64*a*. FIG. 7D shows side elevational view thereof. The transmitter 10 is connected to printed circuit board 18 on which the electronic control system resides. The electronics control system is powered by batteries 19 and these components are housed with the head 20 and body 21 such that the transmitter 10 aligns with a hole 17 in the head 20.

FIG. 7B, similar to FIG. 5A above, shows this embodiment interfacing with the paintball sensing system of a paintball marker. The receiver 11 of the external device 64*a* can also be seen in FIG. 7B. FIG. 7B shows a sectioned view from the front of the paintball marker of a second embodiment interfacing with the paintball sensing system of the paintball marker. FIG. 7C shows a further exploded view of a square version of the configuration device. A housing 66*a* and 66*b* enclose circuit board 68, which is powered by batteries 70. The transmitter 72 and receiver 74 reside on a circuit board 76 which is protected by head housing 78 with aperture 80 therethrough. Another aperture is provided through the head housing on the opposite side (not seen in FIG. 7C) for the receiver 74.

Referring generally to FIGS. 7A through 7D, the external configuration device can be used to interface with a projectile launching device, such as a paintball device. The configuration device, shown in FIG. 5A, is comprised of a body 1 which houses batteries 19. One end of the body 1 is blanked off and fitted with a selector switch 3, a pushbutton 4 and an indicator 13. The other end of the body 1 is arranged to receive the head 20 in which is housed an electronic circuit board 18 such that an optical transmitter 10 is aligned with a hole 17 in the head 20. On the reverse side of the circuit board 18, and on the same centerline as the optical transmitter 10 is an optical receiver 14 (not shown), which is aligned with a second hole 15 (not shown) in the head 20, which is on the same centerline as the first hole 17. When the head 20 is mated to the body 21, the batteries 19 are electrically connected to the circuit board 18 to provide it with electrical power.

FIG. 7C shows a rectangular version of the tubular configuration shown in FIG. 5A but operates in the same way. For example, the square version includes a top cover and a bottom cover with a circuit board that carries electronics. The transmitter 72 and receiver 74 are carried on a separate circuit board 76. An upper housing 66*a* is also provided to enclose the top of the device with the transmitter 72 and receiver 72 therein with the appropriate apertures therethrough. Only one of the apertures can be seen in FIG. 7C but the second one is present on the opposite side that is visible.

The configuration device of FIGS. 5A and 7A-D is preferably used according to the following method. This is one example of the operation of such an external device 64*a* that is used for configuring or reconfiguring a paintball marker.

1. The selector switch 3 is set as required to provide the desired configuration of the paintball marker 50.

2. As seen in FIGS. 5A and 7B, the configuration device 64*b* is inserted into the feed-neck 1 of the paintball marker 50 and pushed down until the head contacts the bottom of the breech 8 (the remainder of the marker is not shown for ease of illustration). The configuration device 64*a* is shown alone in FIG. 7A.

3. The configuration device 64*a* is rotated until the curve of the head 20 sits flush in the curve of the breech 8 and the receiver 11 of the configuration device 64*a* aligns with the transmitter 3 of the paintball marker 50 through a hole 16 in the breech and the transmitter 10 of the configuration device 64*a* aligns with the receiver 4 of the paintball marker 50 through a second hole 17 in the breech.

4. The paintball marker 50 is switched on.

5. The pushbutton (not shown) is pressed to initiate the configuration.

6. An indicator 13 flashes while the configuration device 64*a* transfers configuration data to the paintball marker 50.

7. The configuration data 9 is transferred from the transmitter 10 of the configuration device to the receiver 4 of the paintball marker as a series of pulses of energy.

8. The configuration data 9 is transferred using a protocol that the operating system of the paintball marker 50 needs to decode and the configuration data will be ignored by any marker 50 which has an operating system that does not recognize the protocol.

9. When the configuration data 9 is received by the paintball marker 50 it is checked to ensure that it is valid data before any changes are made to the configuration of the marker 50.

10. Examples of configuration changes include, but are not limited to, restrictions on the firing modes that are available for selection such as single shot, semi-automatic, three-shot burst or fully automatic; restrictions on the speed at which the marker is allowed to cycle; modifications to control parameters that are unique to specific climates; or the enabling of factory fitted hardware options such as graphical user interfaces or audible alarms.

11. During the data transfer the configuration device 64*a* may request data from the paintball marker 50 and this data is transferred from the transmitter 3 of the paintball marker 50 to the receiver 11 of the configuration device 64*a* as a series of pulses of energy.

12. Examples of data that may be transferred to the configuration device 64*a* include, but are not limited to, current configuration; current control parameter values; or fault finding diagnostics.

13. When the data transfer is complete, the indicator 13 stops flashing.

14. The configuration device 64*a* is removed from the marker.

The configuration device 64*a* and its associated method and system has many advantages over prior art devices, methods and systems, including:

A. The re-configuration of a paintball marker 50 is much less time consuming than previous methods.

B. No communications devices have to be incorporated into the electronic control system, reducing the cost of the control system.

C. No specialized knowledge is required by the person making the changes.

D. The equipment is relatively low cost.

E. The equipment is portable.

The configuration device 64*a* may be made out of any suitable material. For example, the body 21 and head 20 may be made of plastic of metal. Circuit board 18 and transmitter 10 and receiver 11 thereon are made of materials and components that are well known in the art.

Referring now to FIG. 8, a further embodiment of the present invention is shown to include the use of a loading device (known as a hopper) as an external device 64*c*, that is capable of interfacing with the projectile launching device 50 and exchanging data therewith. Such a hopper is an application that can take advantage of the method and system of the present invention. Hoppers or loading systems are often gravity fed so paintballs 6 simply fall by gravity into the breech 8 for launching. However, more advanced loading systems 64*c* include mechanical devices therein to better control the flow of paintballs 6 from the loading device 64*c* into the breech 8 of the paintball marker 50. Such devices are typically electrically powered and require some type of communication from the operating system to ensure smooth loading of paintballs 6 and overall operation of the paintball marker 50.

In FIG. 8, paintballs 23 in hopper housing 22, as part of the loading system 64*c*, are ready for loading through feed port 1 into breech 8. Details of the moving parts are not shown for ease of illustration. The focus of FIG. 8 is to show how the loading system 64*c*, as an external device 64, communicates with the paintball marker 50 in accordance with the present invention. More specifically and in conjunction with FIG. 5C, the loading system 64*c* includes its own transmitter 10 and receiver 11 which optically interface with their corresponding light pipes 12 and 13 respectively. Such light pipes 12 and 13, as best seen in FIG. 5C, provide an optical link between the external device 64, in this case a loading system 64*c*, and the paintball marker 50. As a result, even though the external loading system device 64*c* is locating somewhat remote from the transmitter 3 and receiver 4 of the paintball marker 50 itself, the light pipes 12, 13 enable the loading system 64*c* to optically reside between the transmitter 3 and receiver 4 of the paintball marker 50 so it can communicate therewith.

It would be appreciated by those skilled in the art that various changes and modifications can be made to the illustrated embodiments without departing from the spirit of the present invention. All such modifications and changes are intended to be covered by the appended claims.

What is claimed is:

1. A method of transferring data in a projectile launching device, comprising the steps of:

providing a projectile launching device having a breech for receiving a projectile therein for launch;

providing a first optical transmitter, having a range, interconnected to the projectile launching device and residing in the breech;

providing a first optical receiver interconnected to the projectile launching device and residing in the breech;

providing an external device in proximity to the projectile launching device;

providing a second optical transmitter, having a range, interconnected to the external device;

providing a second optical receiver interconnected to the external device;

sending data from the first optical transmitter to the second optical receiver;

sending data from the second optical transmitter to first optical receiver;

whereby the projectile launching device optically communicates with and optically exchanges data over the air with the external device and the first optical transmitter and first optical receiver are configured to optically communicate directly with each other over the air for detecting presence of a projectile in the breech.

2. The method of claim 1, wherein the first optical transmitter sends data to both the first optical receiver interconnected to the projectile launching device and the second optical receiver interconnected to the external device; both the first optical receiver and the second optical receiver being in the range of the first optical transmitter.

3. The method of claim 1, wherein the second optical transmitter sends data to both the first optical receiver interconnected to the projectile launching device and the second optical receiver interconnected to the external device; both the first optical receiver and the second optical receiver being in the range of the first transmitter.

4. The method of claim 1, wherein the first optical transmitter simultaneously sends data over the air to both the first optical receiver interconnected to the projectile launching device and the second optical receiver interconnected to the external device.

5. The method of claim 1, wherein the first optical transmitter sends data over the air, in multiplexed fashion, to both the first optical receiver interconnected to the projectile launching device and the second optical receiver interconnected to the external device.

6. The method of claim 1, wherein the external device is a configuration device for a projectile launching device wherein data sent from the second transmitter to the first optical receiver over the air is configuration data for the projectile launching device.

7. The method of claim 1, wherein the external device is selected from the group consisting of a barrel, projectile loaders, pressure regulators and compressed air bottles.

8. The method of claim 1, wherein the first optical transmitter is optically interconnected over the air to the second optical receiver by a light pipe.

9. The method of claim 1, wherein the second optical transmitter is optically interconnected over the air to the first optical receiver by a light pipe.

* * * * *